US006210235B1

(12) United States Patent
Wu

(10) Patent No.: US 6,210,235 B1
(45) Date of Patent: Apr. 3, 2001

(54) MODULAR JACK TYPE ELECTRICAL CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/315,786

(22) Filed: May 20, 1999

(30) Foreign Application Priority Data

Nov. 20, 1998 (TW) ..... 87219265

(51) Int. Cl.[7] ..... H01R 24/00; H01R 13/648
(52) U.S. Cl. ..... 439/676; 439/607
(58) Field of Search ..... 439/607, 610, 439/676, 344

(56) References Cited

U.S. PATENT DOCUMENTS 4,029,388 * 6/1977 Knoll ..... 439/736
5,766,043 * 6/1998 Talend ..... 439/676
5,934,940 * 8/1999 Maranto et al. ..... 439/607

* cited by examiner

*Primary Examiner*—Lincoln Donovan
*Assistant Examiner*—Chandrika Prasad
(74) *Attorney, Agent, or Firm*—Wei Te Chung

(57) ABSTRACT

A modular jack electrical connector includes an insulative housing defining an interior space for receiving and mechanically engaging with a mating connector. A plurality of contact elements are insert-molded in and retained by first and second spacers which are separated from each other. The contact elements are bent whereby the first and second spacers are substantially normal to each other. The housing further defines a slot in communication with the interior space for receiving and retaining the first spacer therein and the second spacer is attached to an outer face of the housing. A shielding member substantially encloses the housing and the spacers. The shielding member has grounding tabs extending therefrom. The housing has a post extending therefrom corresponding to each of the grounding tabs. The post has an outer face having a flat section abutting against and supporting the grounding tab for providing mechanical strength during insertion thereof into a hole defined in a circuit board. The outer face of the post further has an arcuate section which provides a smooth and substantially non-abrasive engagement with an inside surface of the hole of the circuit board.

11 Claims, 4 Drawing Sheets

MODULAR JACK TYPE ELECTRICAL CONNECTOR

BACKGROUND OF THE INVENTION

1. Field of the Invention

The present invention generally relates to an electrical connector, and in particular, to a modular jack having a simplified structure for facilitating manufacture and assembly thereof.

2. The Prior Art

Modular jacks are widely used in telecommunication systems for facilitating connection of components thereof. Conventional modular jacks are disclosed in Taiwan Patent Application Nos. 78207828, 82201698, 83212694 and 84101576. The conventional modular jack comprises a number of contact elements each being bent and then individually mounted into an insulative member, which hinders the manufacturing process of the modular jack and increases manufacturing costs. Furthermore, the contact elements may not be securely retained in position which may lead to undesired short-circuiting therebetween, causing deterioration of signal transmission quality.

The modular jack is often encased in and shielded by a shielding member for EMI (electromagnetic interference) protection. Conventionally, the shielding member is formed with extensions for grounding to and positioning on a circuit board. Such extensions have a poor mechanical strength which often leads to deformation thereof due to misalignment during insertion into holes defined in the circuit board. In addition, since the extensions are portions of the shielding member which is usually made of a metal plate, the positioning pins have a thin flat configuration which wears away inner surfaces of the holes during insertion into the circuit board thereby damaging the circuit board.

It is thus desirable to provide a modular jack type electrical connector for overcoming the above problems of the prior art connectors.

SUMMARY OF THE INVENTION

Accordingly, an object of the present invention is to provide a modular jack type electrical connector including a spacer for securely retaining the contact elements before insertion into an insulative housing thereby simplifying the manufacturing process.

Another object of the present invention is to provide an electrical connector comprising a unitary shielding member substantially enclosing an insulative housing for EMI protection and having extensions for mounting to a circuit board whereby the extensions are soundly supported by corresponding portions of the housing.

To achieve the above objects, a modular jack electrical connector in accordance with the present invention comprises an insulative housing defining an interior space for receiving and mechanically engaging with a mating connector. A plurality of contact elements are insert-molded in and retained by first and second spacers which are separated from each other. The contact elements are bent whereby the first and second spacers are substantially normal to each other. The housing further defines a slot in communication with the interior space for receiving and retaining the first spacer therein and the second spacer is attached to an outer face of the housing. A shielding member substantially encloses the housing and the spacers. The shielding member has grounding tabs extending therefrom. The housing has a post extending therefrom corresponding to each of the grounding tabs. The post has an outer face having a flat section abutting against and supporting the grounding tab for providing mechanical strength during insertion thereof into a hole defined in a circuit board. The outer face of the post further has an arcuate section which provides a smooth and substantially non-abrasive engagement with an inside surface of the hole of the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
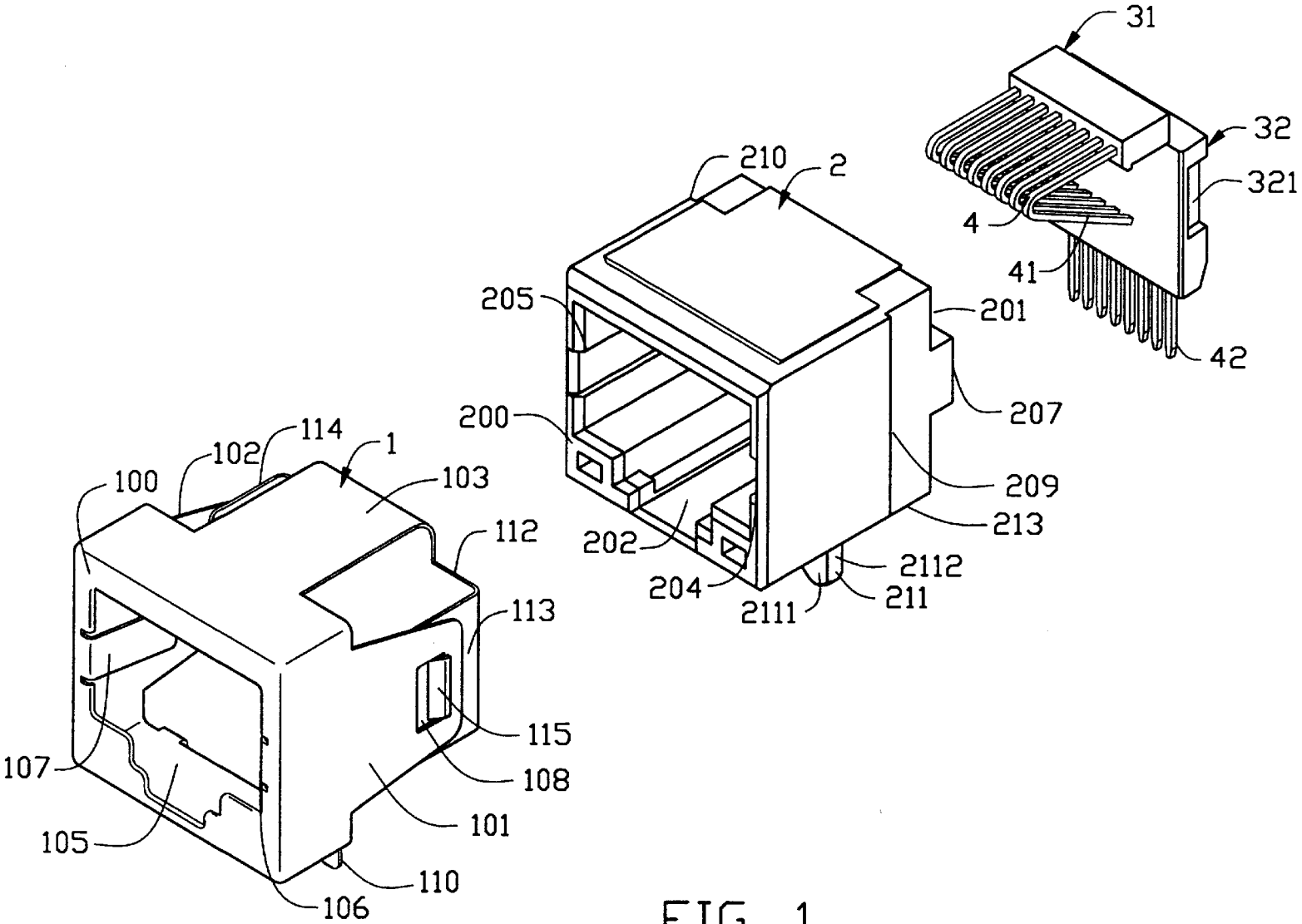
FIG. 1 is an exploded view of an electrical connector constructed in accordance with the present invention.
Figure 2:
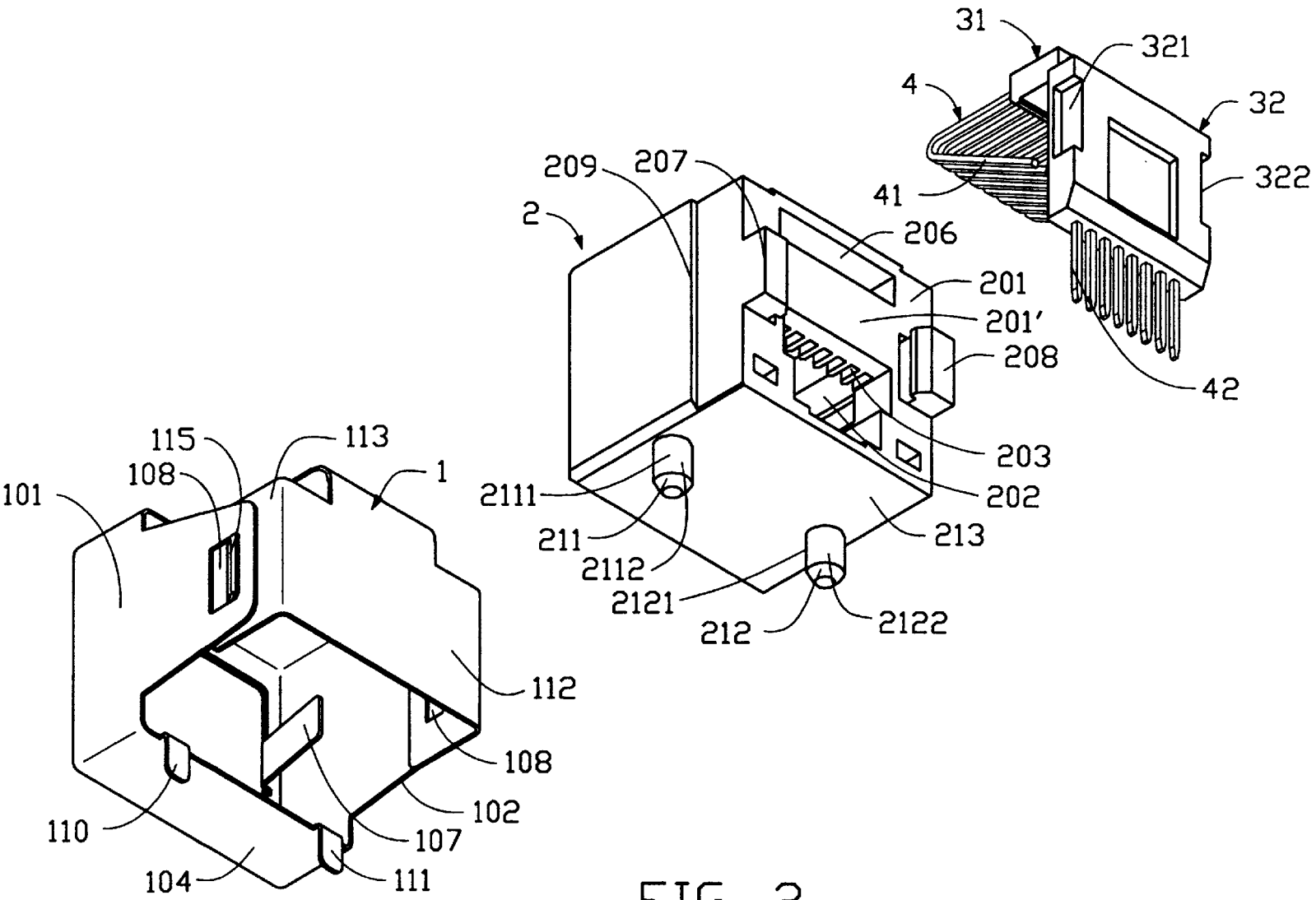
FIG. 2 is similar to FIG. 1 but taken from a different perspective.
Figure 3:
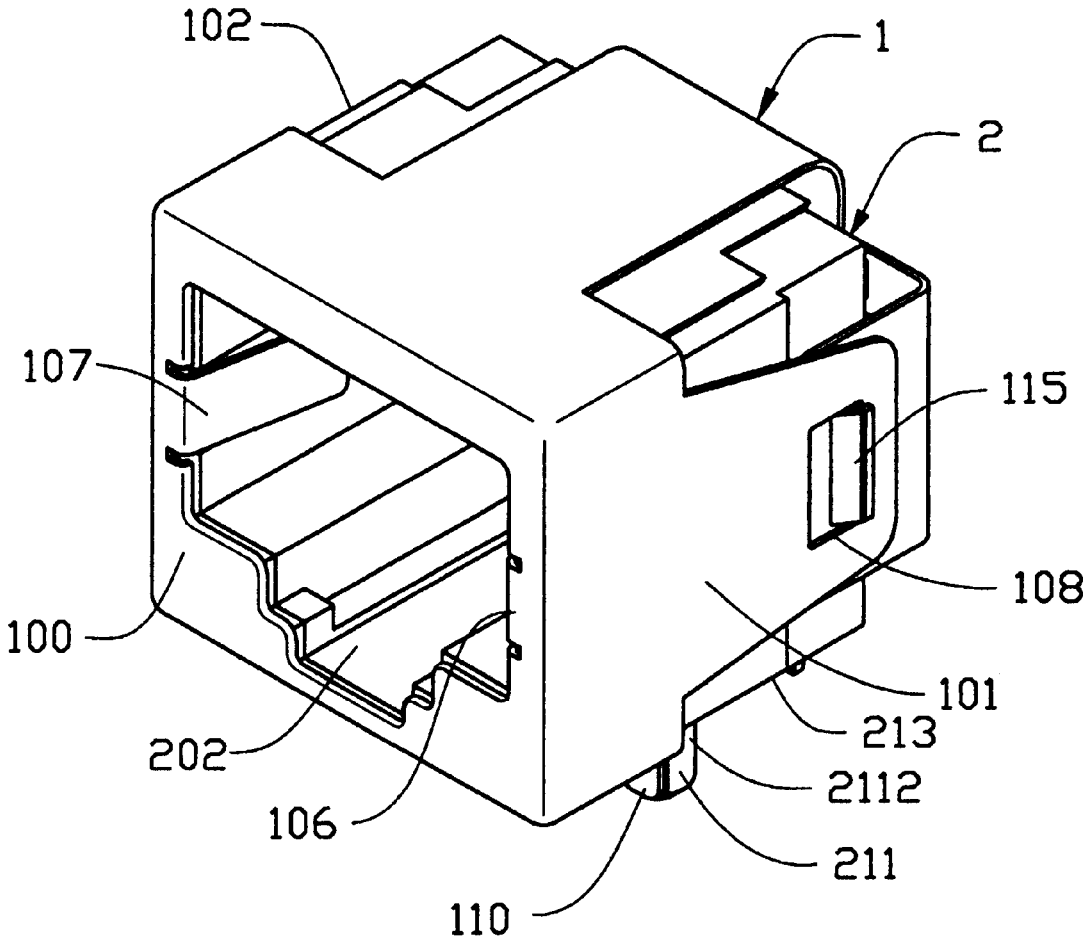
FIG. 3 is an assembled view of FIG. 1.

Referring to the drawings and in particular to FIGS. 1, 2 and 3, an electrical connector in accordance with the present invention comprises an insulative housing 2 enclosed in a shielding member 1. A plurality of contact elements 4 are retained in first and second spacers 31, 32. The spacers 31, 32 are fixed to the housing 2 and enclosed by the shielding member 1. Preferably, the contact elements 4 are insert-molded in the spacers 31, 32 thereby being integrally formed therewith.

Each contact element 4 comprises an elongate body extending through the first and second spacers 31, 32 and the spacers 31, 32 are separated from each other. The contact elements 4 have mating ends 41 extending beyond the first spacer 31 and mounting ends 42 extending beyond the second spacer 32. The contact elements 4 are then bent at a location between the spacers 31, 32 to form a right-angled configuration. The mating ends 41 of the contact elements 4 are further bent to form a sharp angle.

The housing 2 has a mating face 200 and an opposite mounting face 201. An interior space 202 is defined in the housing 2 and exposed to an opening formed in the mating face 200 for reception of a mating connector (not shown). The housing 2 also defines a slot 206 in communication with the interior space 202 and exposed to the mounting face 201. A partition (not labeled, best shown in FIG. 2) is formed between the slot 206 and the interior space 202. The mounting face 201 forms a pair of spaced barbed arms 207, 208.

The first spacer 31 is inserted into the slot 206 whereby the mating ends 41 of the contact elements 4 are located in the interior space 202 of the housing 2. The housing 2 defines a plurality of positioning grooves 203 therein corresponding to and partially receiving the mating ends 41 of the contact elements 4 for further securing the mating ends 41 of the contact elements 4 in position.

The second spacer 32 defines two recesses 321, 322 corresponding to and engaged with the barbed arms 207, 208 of the housing 2 for being securely positioned therebetween and thus fixed to the mounting face 201 of the housing 2. The mounting ends 42 of the contact elements 4 are dimensioned to extend beyond a bottom face 213 of the housing 2.

The shielding member 1 has a front wall 100 defining an opening 105 therein corresponding to the opening of the mating face 200 of the housing 2. A top wall 103, a bottom wall 104 and two front lateral walls 101, 102 extend from edges of the front wall 100 to define an interior space (not labeled) therebetween for receiving the housing 2 whereby the front wall 100 of the shielding member 1 abuts against the mating face 200 of the housing 2. The shielding member 1 further comprises a rear wall 112 extending from the top wall 103 for covering and shielding the mounting face 201 of the housing 2 and the spacers 31, 32. Two rear lateral walls 113, 114 extend from the rear wall 112 and are partially overlapped by the front lateral walls 101, 102. The rear lateral walls 113, 114 have barbs 115 formed thereon and the front lateral walls 101, 102 define openings 108 therein for engaging with the barbs 115 thereby securing the rear lateral walls 113, 114 to the front lateral walls 101, 102. Thus, the housing 2 is securely enclosed within the shielding member 1. The housing 2 is provided with a step 209, 210 on each side face thereof for supporting and accommodating the corresponding rear lateral wall 113, 114 of the shielding member 1.

Furthermore, the shielding member 1 is provided with resilient arms 106, 107 extending into the interior space 202 of the housing 2 from opposite lateral edges of the opening 105. The resilient arms 106, 107 are received in grooves 204, 205 defined in the housing 2 in communication with the interior space 202. The arms 106, 107 fix the shielding member 1 to the housing 2 and electrically engage with a grounding member of the mating connector.

Figure 4:
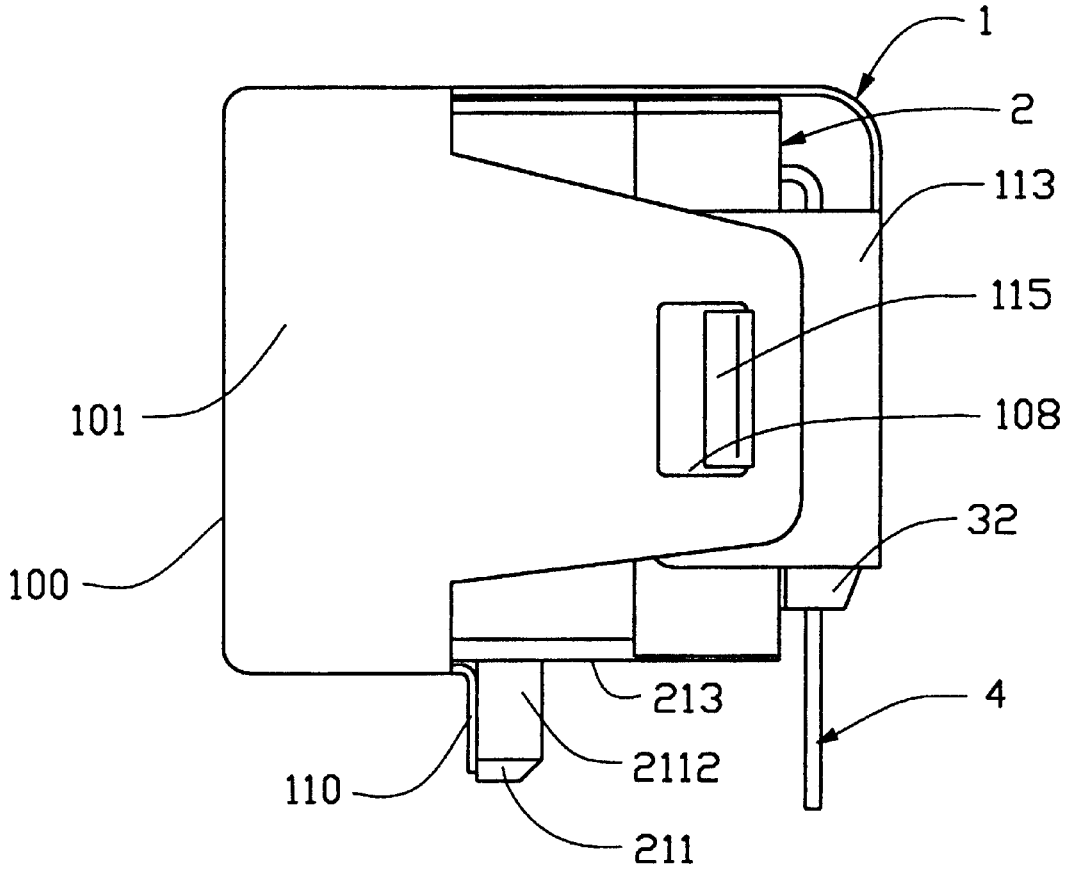
FIG. 4 is a side elevational view of FIG. 3.

Also referring to FIG. 4, the housing 2 has a pair of posts 211, 212 extending from the bottom face 213 thereof. Each post 211 has an outer face comprising a flat section 2111, 2121 and an arcuate section 2112, 2122. A pair of grounding tabs 110, 111 extends from the shielding member 1 and is positioned against the flat sections 2111, 2121 of the outer faces of the corresponding posts 211, 212 of the housing 2. The posts 211, 212 and the grounding tabs 110, 111 are inserted into holes defined in a circuit board (not shown) for fixing and grounding the connector thereto.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A modular jack type electrical connector comprising:

an insulative housing having a mating face and a mounting face, the housing defining an interior space having an opening in the mating face adapted to receive an external connector, a slot being further defined in the housing in communication with the interior space and exposed to the mounting face, a partition being formed between the slot and the interior space; and a horizontal first spacer and a vertical second spacer cooperatively retaining contact elements therein, each contact element having a mating end projecting from a front face of the first spacer and a mounting end projecting out of a bottom face of the second spacer, the contact elements being bent at a location between the first and second spacer, the first spacer being received in the slot of the housing and partially supported by the partition with the mating ends of the contact elements being located in the interior space of the housing for electrically engaging with contacts of the external connector, and the second spacer being attached to the mounting face of the housing with the mounting ends of the contact elements extending beyond the mounting face of the housing through the second spacer.

2. The electrical connector as claimed in claim 1, wherein the mounting face of the housing has two barbed arms and wherein the second spacer defines recesses therein engageable with the barbed arms for attaching the second spacer to the mounting face of the housing.

3. The electrical connector as claimed in claim 1 further comprising a shielding member having a front wall with a top wall, a bottom wall and two front lateral walls extending from edges thereof to define a space therebetween for accommodating the housing with the front wall abutting against the mating face of the housing, the front wall defining an opening corresponding to the opening of the mating face of the housing for receiving the external connector, a rear wall extending from the top wall for covering and shielding the mounting face of the housing, two rear lateral walls extending from the rear wall toward the front lateral walls and being fixed thereto.

4. The electrical connector as claimed in claim 3, wherein each front lateral wall defines an opening and wherein each rear lateral wall forms a barb engageable with the opening to fix the rear lateral wall to the corresponding front lateral wall.

5. The electrical connector as claimed in claim 3, wherein a plurality of arms extend from an inner circumference of the opening of the front wall of the shielding member and are received in corresponding grooves defined in the housing in communication with the interior space thereof for fixing the shielding member to the housing and electrically engaging with a grounding member of the external connector.

6. The electrical connector as claimed in claim 3, wherein the housing comprises a plurality of posts extending from a bottom face thereof, each post having an outer face comprising a flat section and an arcuate section, and wherein the shielding member comprises an extension corresponding to and supported by the flat section of the outer face of each post.

7. The electrical connector as claimed in claim 1, wherein the contact elements are insert-molded in the first and second spacers.

8. A modular jack connector comprising an insulative housing defining an interior space adapted to receive an external connector, contact elements being fixed in the interior space for electrically engaging with contacts of the external connector, a shielding member substantially enclosing the housing and having at least one grounding tab extending therefrom, the improvement comprising a post extending from the housing corresponding to the grounding tab of the shielding member, the post having an outer face comprising a flat section abutting against and supporting the grounding tab.

9. The electrical connector as claimed in claim 8, wherein the outer face of the post further comprises an arcuate section.

10. A modular jack type electrical connector comprising an insulative housing having a mating face and a mounting face, said housing defining an interior space having an opening in the mating face, and a slot in communication with said interior space and exposed to said mounting face, a first spacer and a second spacer integrally securing a plurality of contacts together wherein the first spacer combines mating ends of the contacts and is received within said slot, and the second spacer combines mounting ends of the contacts and is fixed to the mounting face, a shielding member substantially enclosing the housing and the first and second spacers and having at least one grounding tab extending therefrom, the housing comprising a post corresponding to the grounding tab of the shielding member, the post having an outer face comprising a flat section abutting against and supporting the grounding tab.

11. The electrical connector as claimed in claim 10, wherein the mounting face of the housing has two barbed arms and wherein the second spacer defines recesses therein engaging with the barbed arms thereby fixing the second spacer to the mounting face of the housing.

* * * * *